United States Patent [19]

Gendron

[11] Patent Number: 4,566,627

[45] Date of Patent: Jan. 28, 1986

[54] TAMPER DETECTION ENVELOPE

[75] Inventor: Wilfred H. Gendron, Wilbraham, Mass.

[73] Assignee: Westvaco Corporation, New York, N.Y.

[21] Appl. No.: 719,224

[22] Filed: Apr. 2, 1985

Related U.S. Application Data

[63] Continuation of Ser. No. 536,347, Sep. 27, 1983, abandoned.

[51] Int. Cl.[4] ..... B65D 27/14; B65D 27/30

[52] U.S. Cl. ..... 229/81; 206/807

[58] Field of Search ..... 229/81; 383/5; 206/807

[56] References Cited

U.S. PATENT DOCUMENTS

| | | | |
|---|---|---|---|
| 190,630 | 5/1877 | Simonson . | |
| 257,352 | 5/1882 | Lubin | 229/81 |
| 544,277 | 8/1895 | Andrew . | |
| 712,465 | 10/1902 | Stormfels | 229/81 |
| 1,198,288 | 9/1916 | Taylor, Jr. | 229/81 |
| 2,083,158 | 6/1937 | Ramsey | 229/81 |
| 2,128,196 | 8/1938 | Vogel . | |

FOREIGN PATENT DOCUMENTS

| | | | |
|---|---|---|---|
| 62804 | 6/1913 | Austria | 229/81 |
| 542257 | 4/1922 | France | 229/81 |
| 18580 | of 1891 | United Kingdom | 229/81 |
| 17804 | of 1892 | United Kingdom | 229/81 |
| 12386 | of 1894 | United Kingdom | 229/81 |

*Primary Examiner*—Stephen P. Garbe

[57] ABSTRACT

A tamper detection envelope is disclosed wherein the closure flap of the envelope is applied with a pattern of spaced slits to produce a weakened structure that will break during tampering and be obvious under visual observation. The spaced slits are separated by normally unbroken connectors and are arranged in generally parallel lines that criss cross one another at substantially right angles to produce subpanels of a generally diamond configuration within the closure flap. A strip of adhesive is applied between the closure flap and the envelope rear panel at least in the region of the subpanels for closing the envelope. Any subsequent attempt to open the envelope by lifting the closure flap will break the normally unbroken connections between the slits to provide a visual indication that the envelope has been tampered with.

2 Claims, 5 Drawing Figures

TAMPER DETECTION ENVELOPE

This is a continuation of application Ser. No. 536,347 filed Sept. 27, 1983, now abandoned.

BACKGROUND OF INVENTION

The present invention relates generally to envelopes and more particularly to a tamper detection envelope which cannot be opened once it is closed without leaving visible evidence that the envelope was tampered with. Such envelopes are known in the prior art but many are unreliable in use. For instance, some of the known tamperproof envelopes can be steamed open and then resealed without leaving behind visible evidence of the tampering. These envelopes do not rely on the actual severing of portions of the closure flap as disclosed herein, but rely instead on the critical location of certain cut segments which in most cases can be relocated in their proper place after opening by a careful thief.

Examples of prior art tamper detection envelope structures are shown in U.S. Pats. Nos. 190,630; 544,277; 712,465; and 2,128,196. In each of these prior patents, incisions are cut in the envelope closure flaps to produce flaps or designs for showing evidence of tampering. In contrast to these teachings, the present invention employs a different means for tamper detection by using a method that induces the actual tearing of portions of the flap structure when the envelope is tampered with.

SUMMARY OF INVENTION

The present invention relates to envelopes or the like and more particularly to a means for protecting the contents of an envelope from tampering. Such protection is achieved in the present invention by providing the envelope closure flap with a tamper detection means that prevents the envelope from being surreptitiously opened and then resealed without being so marred or mutilated as to make the visible detection of such tampering obvious.

The object of the present invention is carried out by applying the envelope closure flap with a pattern of spaced slits to produce a weakened structure that will break at selected points during tampering. The fracturing of the closure flap at the selected points produces obvious evidence of tampering under visual observation. The spaced slits are arranged in generally parallel lines that criss cross one another at substantially right angles to produce subpanels within the closure flap of a generally diamond shaped configuration. The ends of the spaced slits are separated from one aother by normally unbroken connectors which are subject to being torn when the envelope is tampered with. A strip of adhesive is applied either to the closure flap or to the envelope rear panel at least in the region of the subpanels for closing the envelope. Any subsequent attempt to open the envelope by lifting the closure flap will break the normally unbroken connectors between the slits to provide a visual indication that the envelope has been tampered with. Moreover, when the envelope is finally opened, the subpanels of the closure flap remain adhered to the rear panel of the envelope.

DETAILED DESCRIPTION

Figure 1:
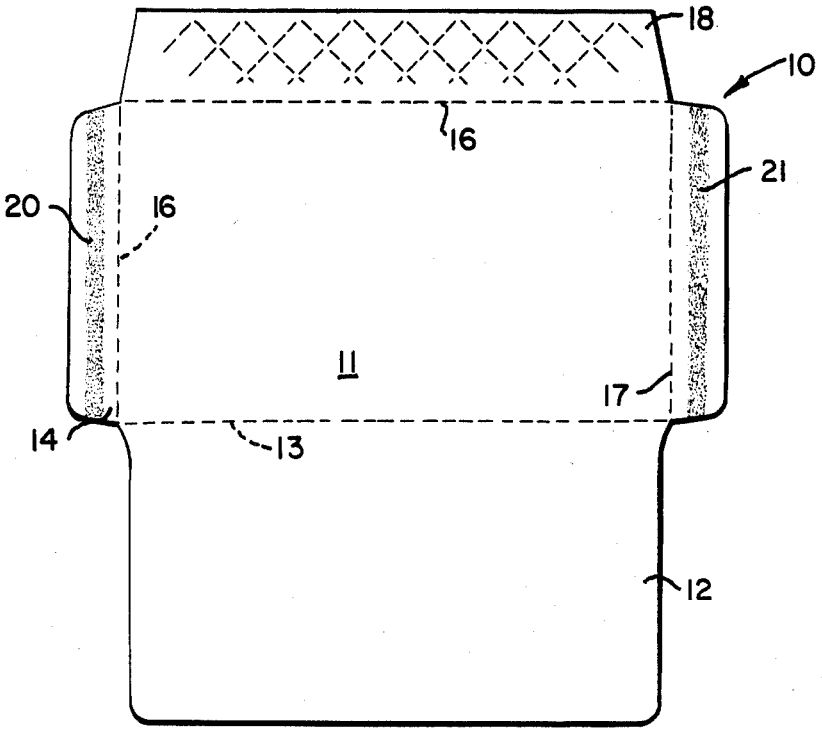
FIG. 1 is a plan view of a blank for preparing an envelope according to this invention.

Referring to the drawings, there is shown in FIG. 1 a paper blank for forming the envelope of the present invention. The blank 10 includes a front panel 11 foldably attached to a rear panel 12 along a score line 13. The front panel also includes a pair of end closure flaps 14,15 foldably attached to the side edges of front panel 11 along score lines 16,17 and an envelope closure flap 18 foldably attached to the top edge along a score line 19. The end closure flaps 14,15 are each applied with adhesive strips 20,21 for closing the ends of the envelope and the closure flap 18 is applied with a selective pattern of slits for weakening the closure flap structure to render it tamper detectable. The pattern is more fully disclosed in FIG. 4.

Figure 2:
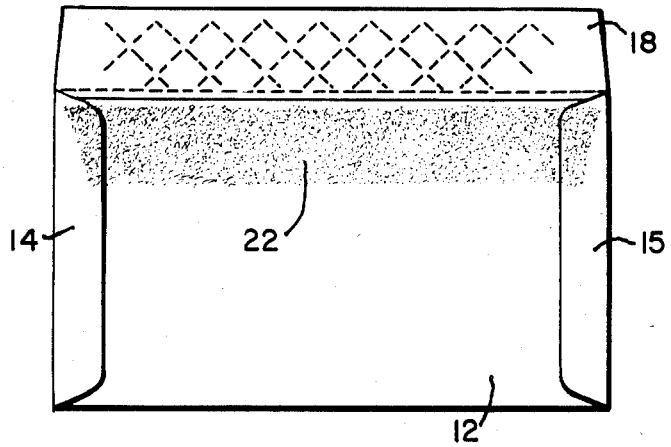
FIG. 2 shows an envelope according to the present invention formed from the blank of FIG. 1 and ready to be filled.
Figure 3:
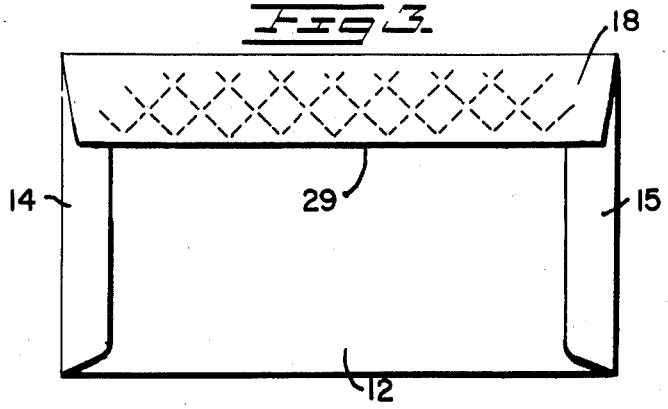
FIG. 3 shows the envelope of FIG. 2 after it has been sealed.

FIG. 2 shows the envelope fully formed and ready to be filled before closing. The envelope is closed with a strip of adhesive 22 applied either to the rear panel 12 or the closure flap 18 itself at least in the region of the applied slit pattern. The type of adhesive used is not critical. It may be of the dry type that is wetted for use, a pressure sensitive adhesive normally covered before use with release paper or a dry type adhesive that will only adhere to another surface coated with similar adhesive. Once the envelope is closed as shown in FIG. 3, the closure is fully tamper detectable.

Figure 4:
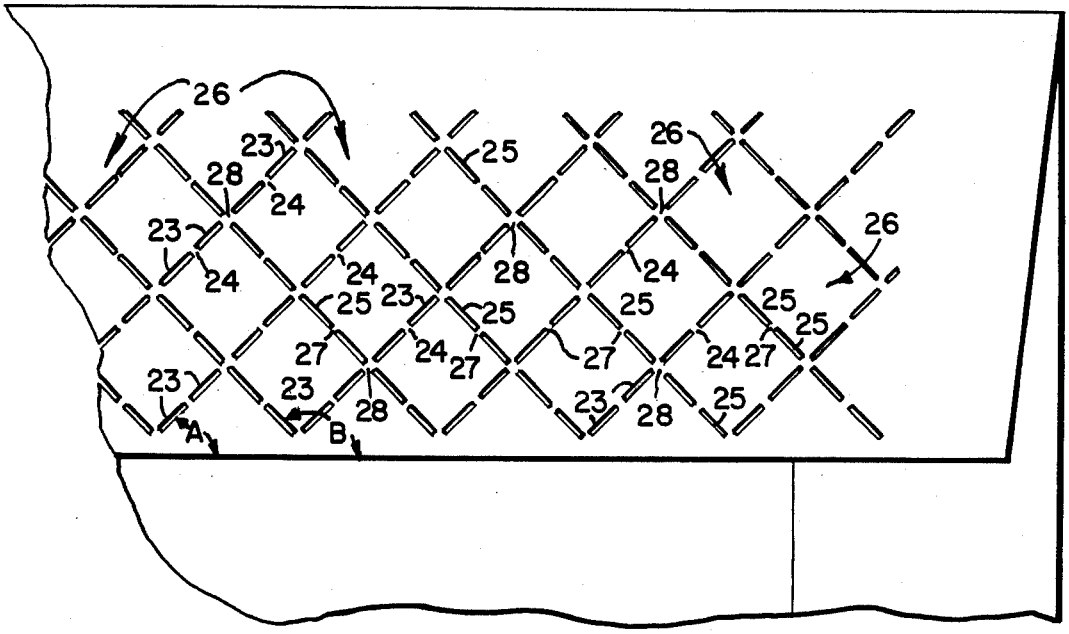
FIG. 4 is an enlarged fragmentary view of the closure flap of the envelope of the present invention showing in detail the pattern of slits applied to the closure flap; and, FIG. 5 is a plan view of the envelope of the present invention showing the result of lifting the closure flap during a tampering incident.

The pattern of slits preferred is shown in FIG. 4. The orientation of the slits is designed so that the connectors between the slits are located in places where lifting of the closure flap from any angle will produce stresses that fracture the connectors. In this manner there is no possibility that a careful thief can find a method for opening the envelope without producing some visible evidence of tampering. For this purpose a first set of spaced slits 23 are applied to the closure flap 18 in substantially straight, parallel lines which extend at an acute angle A with a free edge 29 of the closure flap. The slits 23 may be made any convenient length depending upon the size of the flap, and they are separated from one another by connectors 24 which are normally unbroken. A second set of spaced slits 25 are also applied to the closure flap 18 in substantially straight, parallel lines which extend at an obtuse angle B with respect to the free edge 29 of the closure flap in essentially a criss cross pattern. In a preferred form, the lines of slits 23 and 25 extend at substantially right angles to one another so as to form a plurality of generally diamond shaped subpanels 26 within the closure flap. The slits 25 are separated from one another by connectors 27 and the points where the lines of slits 23,25 might normally intersect form additional connectors 28. Each of the connectors 24,27 and 28 are normally unbroken but are susceptible of being fractured when a closed envelope is tampered with.

Figure 5:
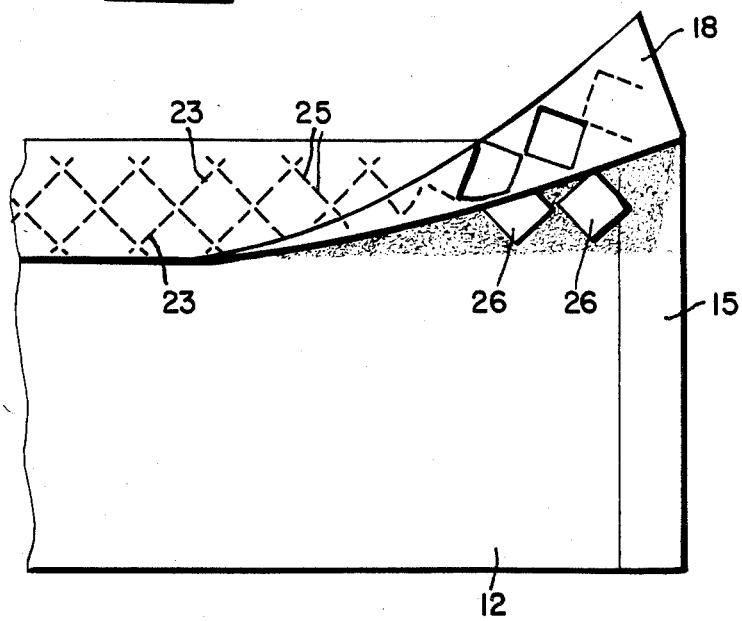

FIG. 5 illustrates how the envelope reacts when it is opened. It will be apparent that any lifting of the closure flap 18 will cause one or more of the connectors 24,27 and 28 to be severed. This disturbance to the closure flap integrity will make it visually apparant that the envelope has been tampered with. Moreover, when the closure flap is lifted further, all of the connectors 24,27 and 28 are broken so that the diamond shaped subpanels 26 remain adhered to the rear panel 12.

Accordingly, there is illustrated and described a preferred embodiment of the present invention, however, it will be obvious that changes may be made therein within the spirit and scope of the appended claims.

I claim:

1. In a tamper detectable envelope, the combination of a body portion formed from a front panel and rear panel with side flaps foldably connected to one of said panels and adhered to the other of said panels, a closure flap foldably connected along a score line to the top edge of one of said panels and adapted to be adhered to the other of said panels, said closure flap including:

(a) opposed side edges and a straight free edge opposite said score line;

(b) a plurality of spaced apart and parallel lines of slits applied to the closure flap which extend substantially from one side edge thereof to the other, and which criss cross one another at substantially right angles to produce a plurality of subpanels within the closure flap of generally diamond shaped configuration, each of said slits being separated from the next succeeding slit in its line and from the adjacent slits in the criss cross lines by normally unbroken connectors, said connectors comprising uncut segments of the closure flap located at least at each point of each diamond shaped subpanel, said parallel lines of slits extending from the general area of said score line to a point substantially near the free edge of said closure flap; and, (c) adhesive material applied between the closure flap and said other panel so that after the envelope is closed and sealed, any attempt to open the envelope by lifting the closure flap will sever one or more of the connectors between said slits and leave attached to said other panel one or more of the generally diamond shaped subpanels of said closure flap to provide visual evidence that the envelope has been tampered with.

2. A tamper detectable envelope comprising a body portion formed from a front panel and rear panel with side flaps foldably connected to one of said panels and adhered to the other of said panels, a closure flap foldably connected along a score line to an edge of one of said panels and adapted to be adhered to the other of said panels, said closure flap including:

(a) opposed side edges and a straight free edge opposite said score line;

(b) a first plurality of spaced apart and parallel lines of slits applied to the closure flap which extend at an acute angle with the free edge of said closure flap substantially from one side edge to the other, each of said slits being separated from one another by a normally unbroken connector, said first lines of slits extending from the general area of said score line to a point substantially near the free edge of said closure flap;

(c) a second plurality of spaced apart and parallel lines of slits applied to the closure flap which extend at an obtuse angle with the free edge of said closure flap substantially from one side edge to the other, said second lines of slits extending from the general area of said score line to a point substantially near the free edge of said closure flap at regular intervals to cross said first lines of slits and produce generally diamond shaped subpanels within said closure flap, the slits in said second set of lines being separated from one another and from the slits in the first set of lines by normally unbroken connectors, said connectors being located at least at each point of each diamond shaped subpanel; and, (d) adhesive material applied between the closure flap and said other panel at least in the region of said subpanels so that after the envelope is closed and sealed, any attampt to open the envelope by lifting the closure flap will sever one or more of the connectors between said slits and leave attached to said other panel one or more of the generally diamond shaped subpanels of said closure flap to provide visual evidence that the envelope has been tampered with.

* * * * *